US006364687B1

(12) United States Patent
Chen

(10) Patent No.: US 6,364,687 B1
(45) Date of Patent: Apr. 2, 2002

(54) CABLE CONNECTOR

(75) Inventor: Wen-Chin Chen, Taipei Hsien (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/618,388

(22) Filed: Jul. 18, 2000

(51) Int. Cl.[7] ..... H01R 13/627
(52) U.S. Cl. ..... 439/358; 439/607
(58) Field of Search ..... 439/350–358, 439/607, 608, 610

(56) References Cited

U.S. PATENT DOCUMENTS 5,749,746 A * 5/1998 Tan et al. ..... 439/357
5,797,771 A * 8/1998 Garside ..... 439/358
6,099,339 A * 8/2000 Yanagida et al. ..... 439/358
6,113,413 A * 9/2000 Cronin et al. ..... 439/352

FOREIGN PATENT DOCUMENTS

EP 844695 * 5/1998
JP 10302893 * 11/1998

* cited by examiner

*Primary Examiner*—Hien Vu
(74) *Attorney, Agent, or Firm*—Pro-Techtor International Services

(57) ABSTRACT

A cable connector that includes an insulating casing, a plurality of terminals installed on the insulating casing, an obstruction unit covering the insulating casing, and an outer casing to accommodate the obstruction unit and the insulating casing. The cable connector includes on the obstruction unit a supporting arm that snaps into engagement with a matching connector. On the supporting arm is a check part that contacts the insulating casing of the cable connector. Also on the supporting arm is an activating part with a vertical height higher than that of the check part. Corresponding to the activating part is a pressing unit that drives the activating part downward when depressed, thereby moving the supporting arm down to release the cable connector.

4 Claims, 8 Drawing Sheets

CABLE CONNECTOR

BACKGROUND OF THE INVENTION

1. Field of the Invention

The invention relates generally to a cable connector, and more particularly to a mobile phone cable connector.

2. Description of Related Art

As disclosed in the Japanese patents by Te-Kai-Ping 8-273764, 10-15455, 11-162566 and 10-302893, the conventional type of cable connector employing snaps for connection with a matching connector involves the construction of snaps or hooks installed on the connector to achieve the purpose of engagement. So although the designs of the snaps or hooks may differ slightly, they must be equipped with adequate operating flexibility to enable engaging and disengaging. Shortcomings do exist in prior art cable connectors, particularly in the assembly or operation of the hooks or snaps. For instance: due to restrictions on the configuration of the obstruction unit for Japanese 8-273764, the depressing controls required for engaging and disengaging would greatly impede its applicability. In the case of Japanese 10-154550 and 10-302893, the sophisticated construction of the device makes it difficult to assemble and produce. Furthermore, because of the large intervals between conductive terminals of conventional cable connectors, their assembling processes often result in inconvenience.

OBJECTIVES OF THE INVENTION

The objective of the present invention connector is to provide a cable connector with simplified production and assembly, and excellent control of engagement and disengagement.

Another objective of this invention of cable connector is to provide a cable connector to facilitate convenient assembly of conductive terminals, reducing the formation intervals between terminals by the innovative configuration of the conductive terminals, thereby enabling simplification of the assembling processes.

SUMMARY OF THE INVENTION

The cable connector of the present invention is characterized in that there is a supporting arm on the obstruction unit of the cable connector that is engaged with a matching connector. On the supporting arm is a check part. After the check part is installed in position with the obstruction unit, the check part is pressed against the insulating casing of the cable connector so that the supporting arm will be firmly snapped in engagement with a matching connector.

Another characteristic of the present invention is that next to the check part of the supporting arm is an activating part that extends above the check part. Positioned above the activating part is a pressing unit that will drive the activating part downward when pressed, thereby moving the supporting arm downward to disengage the connector. The pressing unit is a flexible metal plate.

BRIEF DESCRIPTION OF THE DRAWINGS

The invention can be fully understood by reading the following detailed description of the preferred embodiments, with reference made to the accompanying drawings, wherein.

DETAILED DESCRIPTION OF PREFERRED EMBODIMENTS

Figure 1:
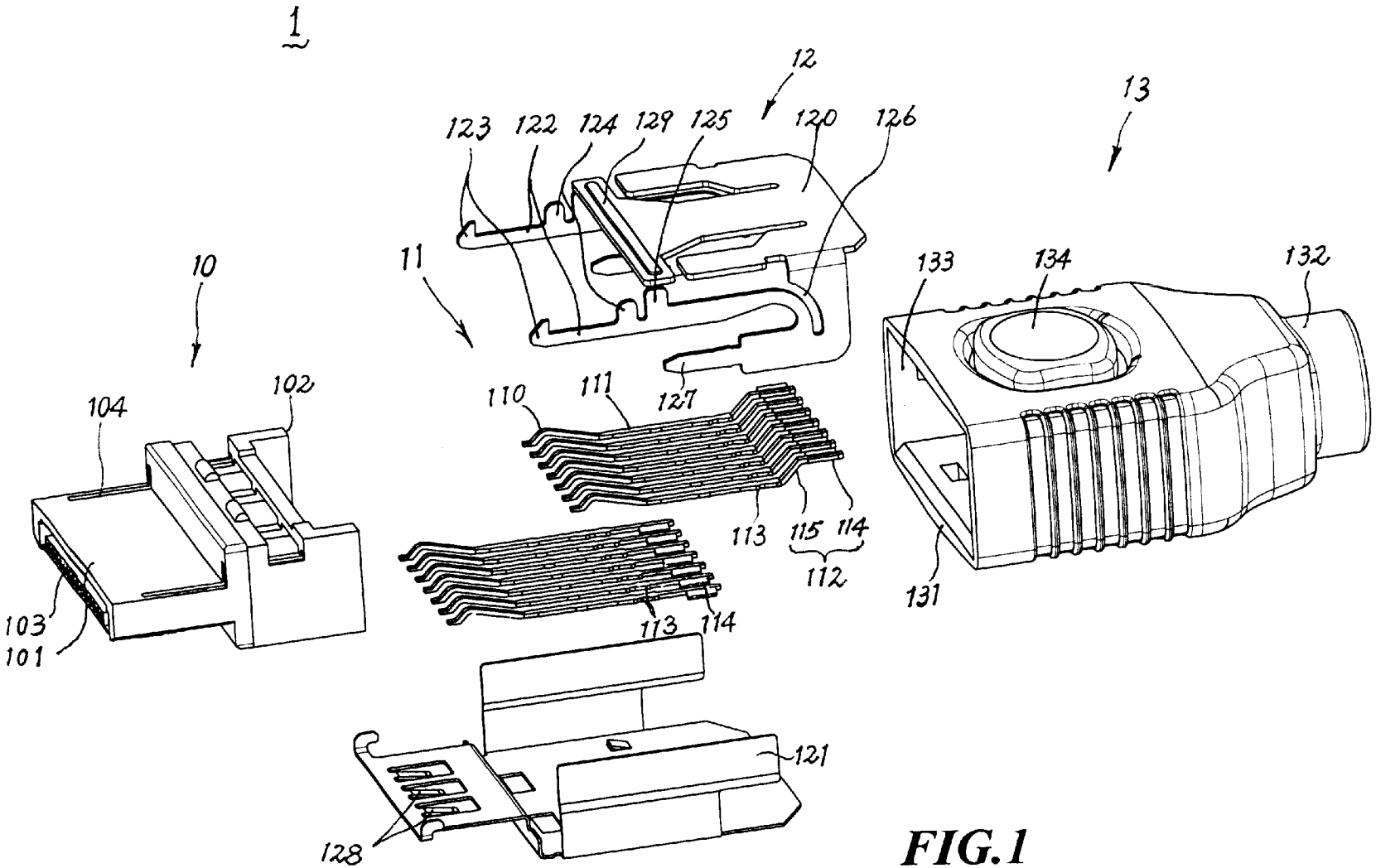
FIG. 1 is an exploded view of the cable connector of the present invention.

Referring first to FIG. 1, the present invention is a cable connector 1 comprising an insulating casing 10, a plurality of terminals 11, an obstruction unit 12, and an outer casing 13. The insulating casing 10 has a coupling surface 101 and a joining surface 102. A terminal accommodating groove 103, which serves to receive the plurality of terminals 11, passes through the coupling surface 101 and the joining surface 102. On one side of the coupling surface 101 is an embedding groove 104. The embedding groove 104 extends from one side of the joining surface 102 through to the coupling surface 101, and serves to receive a supporting arm 122 which will be described in greater detail below.

The plurality of terminals 11 are assembled in two rows in the terminal accommodating groove 103. The terminals 11 each have a contact part 110, an interference part 11, and a joining part 112. A first row of terminals 111 have contact parts 110 formed with an arched surface. The interference part 111 is extended from the arched surface to form an interference unit 113. The joining part 112 is extended horizontally from the end of the interference part 111 to form a first side of a V channel 114 at the end for connection with the power cord. A second row of terminals 11 have contact parts 110 and interference parts 111 identical to the first row. The joining parts 112 of the second row of terminals 11 is angled upward at the end of the extension of the interferences part as a stepped formation 115, forming the second side of the V channel 114.

Figure 4A:
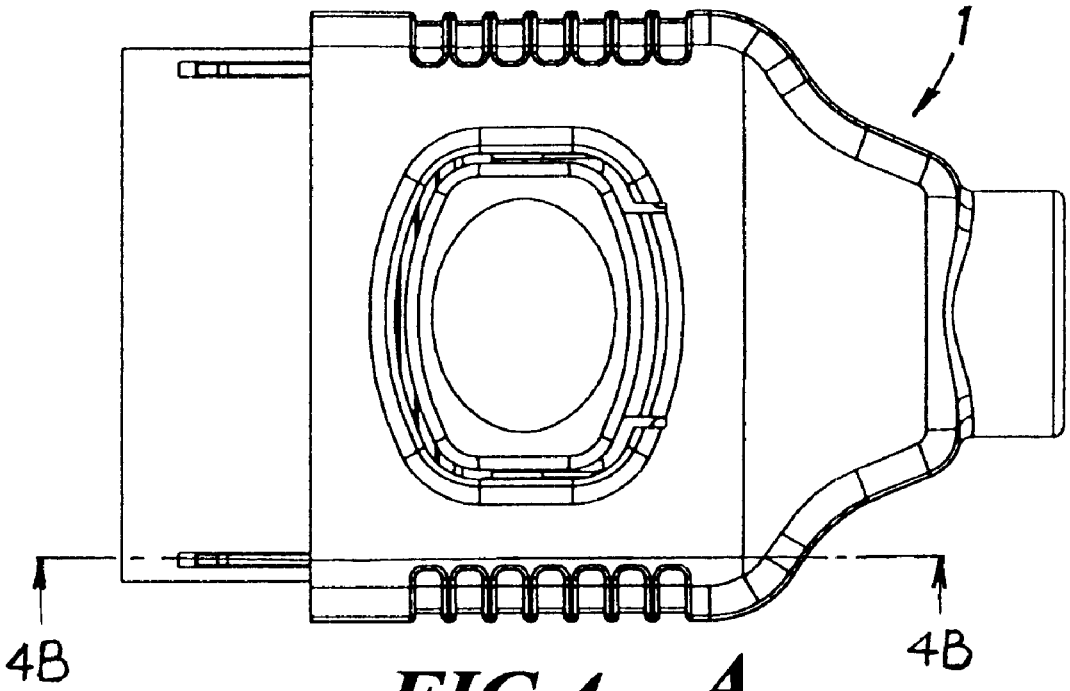
FIG. 4A is a top view of the connector.
Figure 4B:
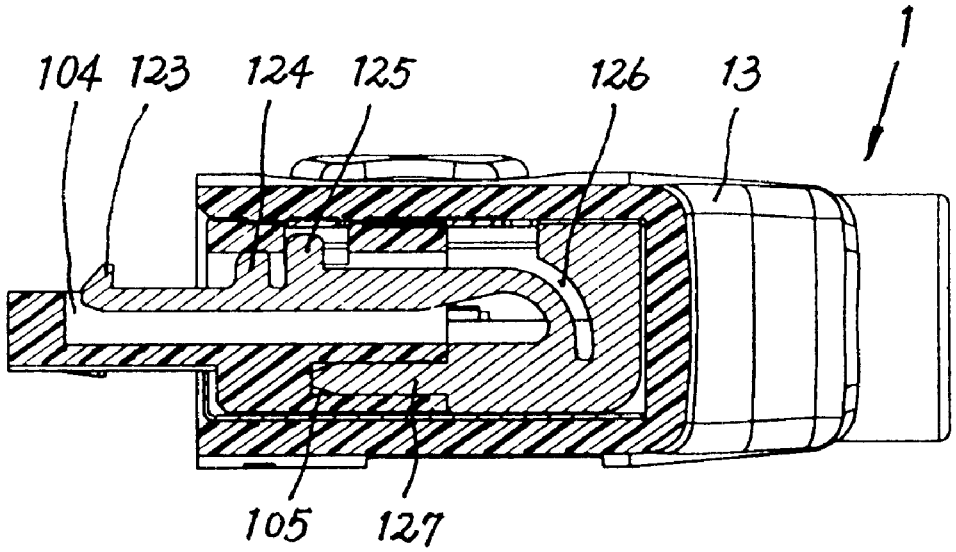
FIG. 4B is a sectional view taken along line 4B—4B in FIG. 4A.

The obstruction unit 12 comprises an upper obstruction unit 120 and a lower obstruction unit 121, inserted respectively in upper and lower portions of the insulating casing 10. The upper obstruction unit 120 contacts the joining surface 102 of the insulating casing 10. Supporting arms 122 extend from two sides of the upper obstruction unit 120. Each supporting arm 122 has an arched opening 126 to provide flexibility. At the end of each support arm 122 is a hook 123 which snaps into a corresponding slot connector. As shown in FIG. 4B, the supporting arm 122 has a check part 124 that presses against the insulating casing 10 after assembly, so that the supporting arm 122 is pressed slightly downward.

After begin assembled, the hook 123 of the supporting arm 122 extends out of the embedding groove 104 of the insulating casing 10. Next to the check part 124 is an activating part 125 which extends higher than the check part 124. The activating part 125 serves as a location where force can be applied to move the supporting arm 122. As shown in FIGS. 1 and 4B, the supporting arm 122 has a connecting surface 127 which is joined to a matching joining hole 105 on the insulating casing 10 to secure the upper obstruction unit 120.

On the to side of the upper obstruction unit 120 is a flexible pressing plate 129. The pressing plate 129 drives the linked supporting arm 122 downward when depressed.

The lower obstruction unit 121 serves to obstruct the bottom side of the insulating casing 10. At a location corresponding to the coupling surface 101 are a plurality of grounding guide plates 128 to conduct out extraneous signals.

On the insulating casing 13, corresponding to the coupling surface 101 and the joining surface 102 of the insulating casing 10, are an assembling surface 131 and a combining surface 132. An assembly groove 133 passes through the assembling surface 131 and the combining surface 132. The assembling groove 133 serves to receive the insulating casing 10. On the top of the outer casing 13 is a pressing unit 134 located above the top of the pressing plate 129 to allow a user to depress the pressing plate 29. In other words, when you press on the pressing unit 134, the pressing plate 129 will move along with the supporting arm 122.

Figure 2A:
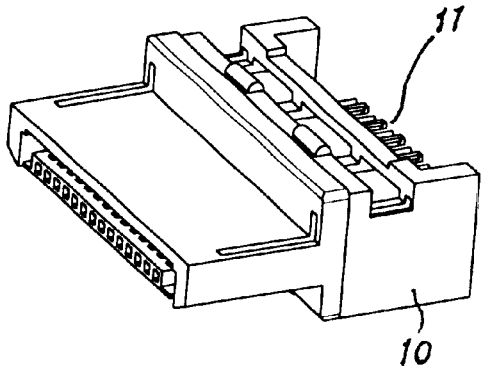
FIGS. 2A, 2B, and 2C illustrate how the cable connector is assembled.
Figure 2B:
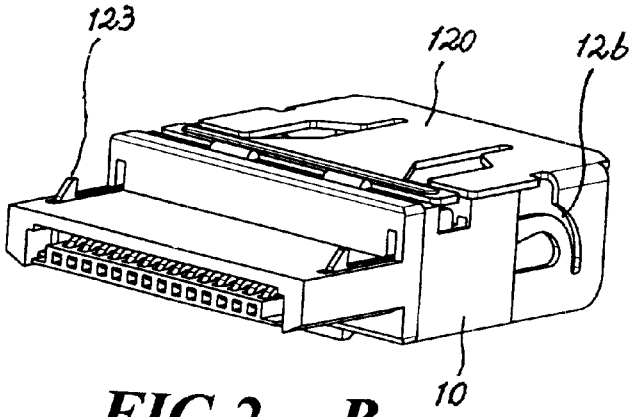
Figure 2C:
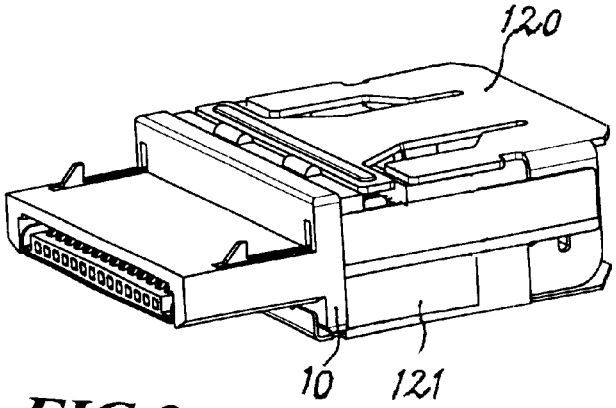
Figure 3:
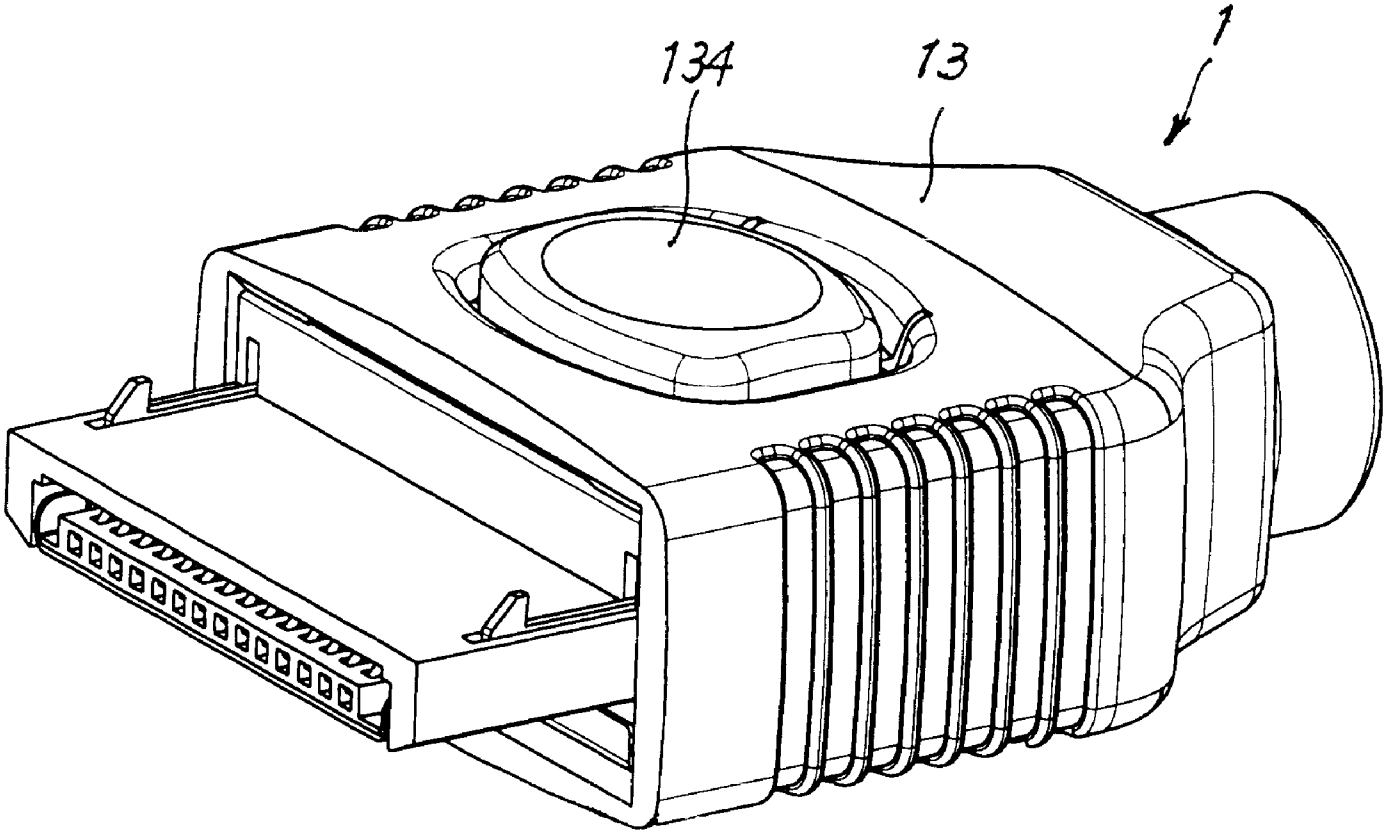
FIG. 3 is a perspective view of the assembled cable connector.

Please refer to FIGS. 1, 2A, 2B, and 2C, which illustrate how the invention is assembled. First, the two rows of terminals 11 are assembled in the terminal accommodating groove 103. Then, as shown in FIGS. 2B and 2C, the upper obstruction unit 120 and the lower obstruction unit 121 are assembled onto the insulating casing. Finally, the outer casing 13 is mounted to complete the assembly as shown in FIG. 3.

Figure 5:
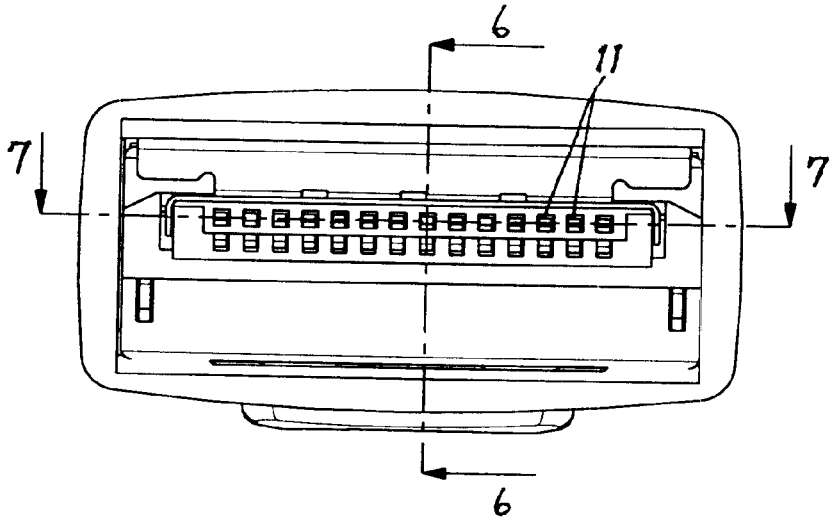
FIG. 5 is a front view of the cable connector.
Figure 6:
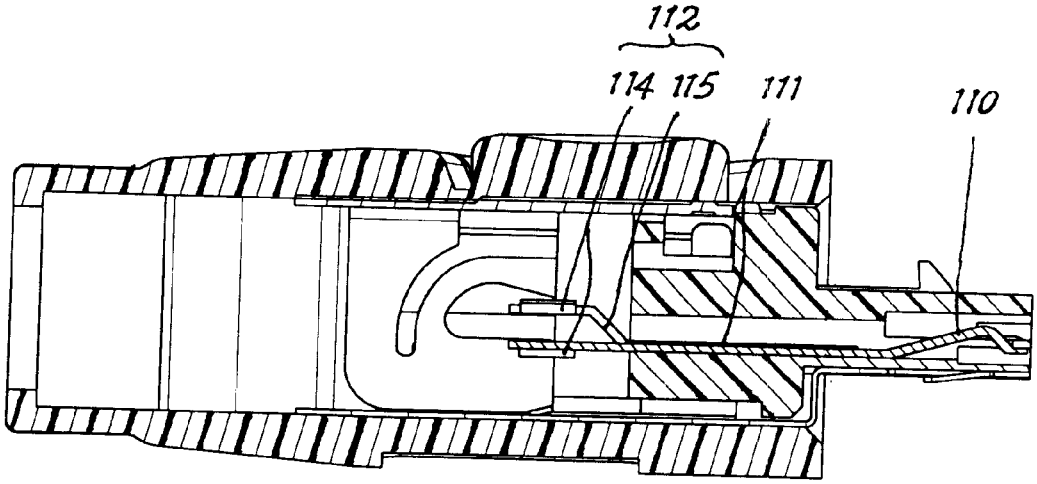
FIG. 6 is a sectional view taken along line 6—6 in FIG. 5.
Figure 7:
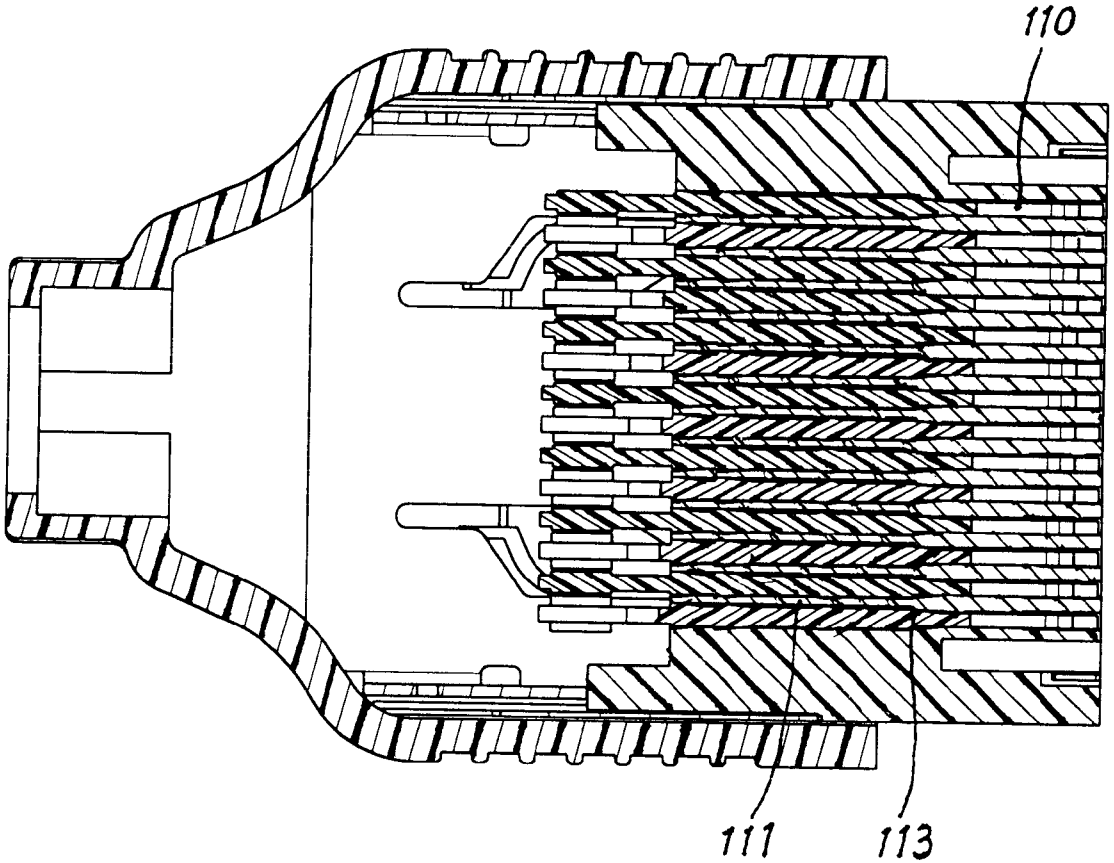
FIG. 7 is a sectional view taken along line 7—7 in FIG. 5.

FIG. 5 is a front view of the invention after it is assembled. The lengthwise section (FIG. 6) and the cross section (FIG. 7) of the front view show that the contact parts 110 of the terminals 11 are accommodated in the front part of the terminal accommodating groove 103 in order to enable connection with the terminals of the matching socket connector. The V channel 114 on the joining part 112 can be connected to the power cord.

Figure 8:
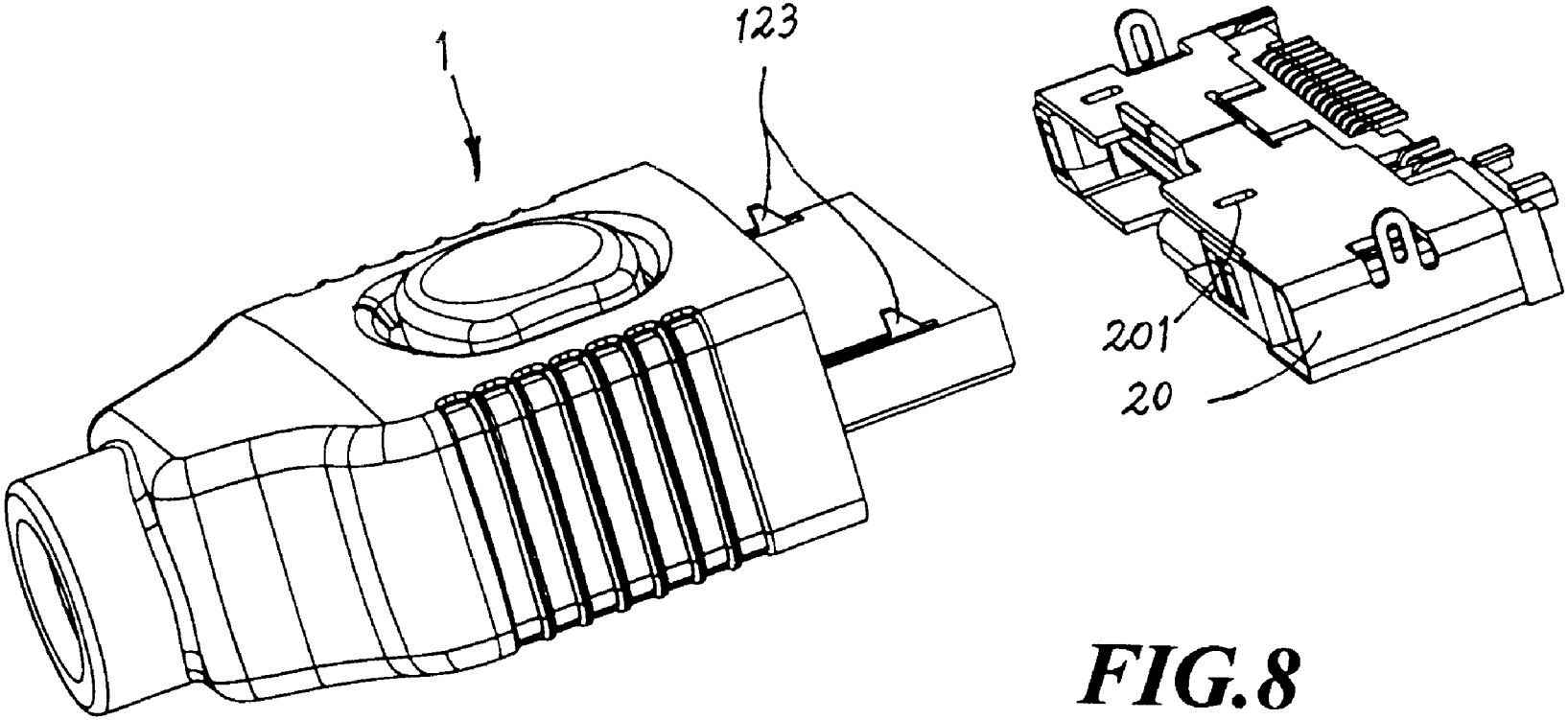
FIG. 8 is a disassembled view of the cable connector and a matching socket connector.
Figure 9:
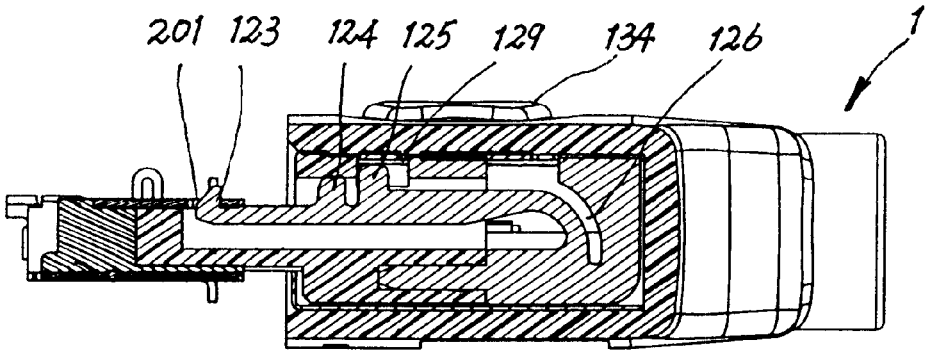
FIG. 9 is a sectional view of the cable connector when coupled by a socket connector.
Figure 10:
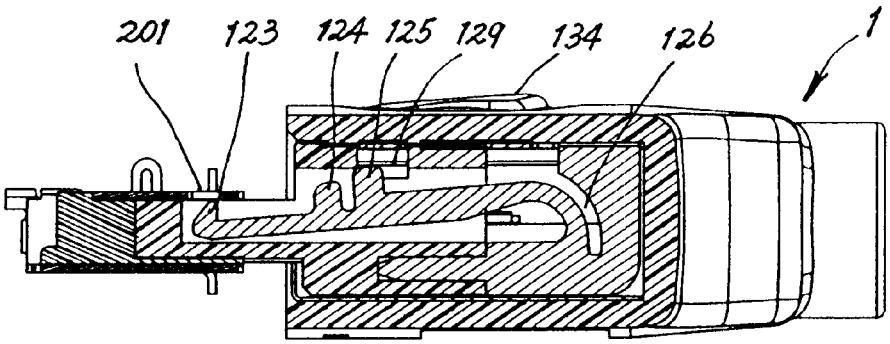
FIG. 10 is a sectional view taken of the connector as it is being disengaged.

As shown in FIG. 8, the cable connector 1 of the present invention can be firmly connected to transmit electronic signals by snapping the hook 123 of the supporting arm 122 into the snap hole 201 of the socket connector 20. FIGS. 9 and 10 illustrate how the hook 123 is engaged with and disengaged from the snap hole 201. In FIG. 9, it can be seen that, because of the biasing force created from the press part 124 of the supporting arm 122 pressing onto the insulating casing 10, the hook 123 provides the supporting arm 122 with a constant upward resiliency. Therefore, when the pressing unit 134 is pressed down, it will push down the pressing plate 129 and the activating part 125, and the entire supporting arm 122 moves down, disengaging the hook 123 from the snap hole 201 (as shown in FIG. 10), so that the cable connector 1 can be pulled out.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A cable connector for a mobile phone, comprising:

an insulating casing with a coupling surface and a joining surface, a terminal accommodating groove is located in an interior of said coupling surface and said joining surface, said coupling surface includes at least one embedding groove, a plurality of terminals assembled in said terminal accommodating groove, each said terminal comprising a contact part, an interference part, and a joining part, a conductive obstruction unit installed on the insulating casing, said obstruction unit comprising at least one supporting arm corresponding in position to said at least one embedding groove of said insulating casing, said supporting arm extends from an arched opening on said obstruction unit so as to provide flexibility in a vertical plane to said supporting arm, said supporting arm comprises a hook, a check part, and an activating part, said activating part extending upward higher than said check part, said check part contacts said insulating casing when said cable connector is assembled, said obstruction unit further comprising a press plate positioned so as to movably contact said activating part, and an outer casing comprising an assembling surface and a combining surface corresponding to said coupling surface and said joining surface of said insulating casing, an interior of said outer casing comprises an assembling groove to receive said insulating casing, said outer casing further comprises a pressing unit; such that when said cable connector is assembled, said at least one supporting arm of said obstruction unit is received in said at least one embedding groove of said insulating casing, and when said cable connector is inserted into a receiving slot connector unit, said hook of said supporting arm is received in an aperture of the slot connector unit to secure said cable connector in said slot connector unit, and when said pressing unit of said outer casing is depressed, said press plate of said obstruction unit pushes down said activating part of said at least one supporting arm so that said cable connector is easily removed from said slot connector unit and wherein said plurality of terminals comprise a first row of terminals and a second row of terminals, each of said first row of terminals comprising an arched surface, said interference parts of said terminals in said first row extending from said arched surface to form an interference, said joining parts of said terminals in said first row extending horizontally from ends of said interference parts to form a first half of a V channel, and each of said second row of terminals comprising a stepped formation at an end of said interference part to form a second half of said V channel.

2. The cable connector as claimed in claim 1, wherein:

a side of said obstruction unit comprises a joining surface located below said supporting arm, and a corresponding joining hole on said insulating casing being provided for mutual engagement.

3. The cable connector as claimed in claim 1, wherein:

said pressing plate is integral to said obstruction unit.

4. The cable connector as claimed in claim 3, wherein:

on said pressing plate is a longitudinal protrusion.

* * * * *